US006215965B1

(12) United States Patent
Sato

(10) Patent No.: US 6,215,965 B1
(45) Date of Patent: Apr. 10, 2001

(54) IMAGE FORMING APPARATUS HAVING A TRANSFER MEDIUM DETECTING MEANS

(75) Inventor: Hitoshi Sato, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/385,894

(22) Filed: Aug. 30, 1999

(30) Foreign Application Priority Data

Aug. 31, 1998 (JP) ..... 10-244598

(51) Int. Cl.[7] ..... G03G 15/00; G03G 15/20

(52) U.S. Cl. ..... 399/16; 271/265.01; 399/322; 399/389

(58) Field of Search ..... 399/16, 45, 322, 399/389, 400, 405; 271/265.01, 265.02

(56) References Cited

U.S. PATENT DOCUMENTS 4,876,576 * 10/1989 Itaya et al. ..... 399/322
5,268,726 * 12/1993 Oleksa et al. ..... 399/322
5,659,836 * 8/1997 Hyskutake et al. ..... 399/16
6,151,458 * 11/2000 Sato et al. ..... 399/16

FOREIGN PATENT DOCUMENTS 63-149669 6/1988 (JP) .

* cited by examiner

*Primary Examiner*—Sophia S. Chen
(74) *Attorney, Agent, or Firm*—Fitzpatrick, Cella, Harper & Scinto

(57) ABSTRACT

An image forming apparatus has a transfer medium detector contact member. The detector serves to detect the passage of a transfer medium by linear movement, swing movement, or like movement of the contact member in contact with a sheet of transfer medium separately fed. The contact member has a contact portion brought into contact with the transfer medium formed of a roller which is held rotatably and is adapted to rotated by the passage of the transfer medium.

10 Claims, 3 Drawing Sheets

IMAGE FORMING APPARATUS HAVING A TRANSFER MEDIUM DETECTING MEANS

BACKGROUND OF THE INVENTION

1. Field of the Invention

The present invention relates to an electrophotographic or electrostatic image forming apparatus. In particular, the present invention relates to an image forming apparatus which forms a visible image on an image-holding member and transfers the visible image onto a transfer-receiving medium (or a printing sheet, hereinafter referred to as a "transfer medium"). The image forming apparatus is preferably realized in a multicolor or unicolor electrophotographic copying machine, and a laser beam printer.

2. Related Background Art

As an example of conventional image forming apparatuses, a color laser beam printer is explained. The color laser beam printer has a drum-shaped electrophotographic photosensitive member, namely a photosensitive drum, held rotatably in the center portion of the apparatus and rotating in one direction. Around the photosensitive drum, there are provided a primary electrifier for charging electrically the photosensitive drum uniformly, a laser beam light exposing means for projecting image information to form a latent image, a plurality of developing devices for developing latent images to form visible images (toner images), and an intermediate transfer belt as an intermediate transfer member for receiving the visible images from the photosensitive drum. The toner image formed on the photosensitive d rum is transferred onto the surface of the intermediate transfer belt. The toner remaining on the photosensitive drum is removed by a cleaning device for use of the photosensitive drum in the subsequent image formation process.

By repetition of the above process, the color toner images are transferred in superimposition on the intermediate transfer belt. Thereafter, the multicolor toner image is transferred from the intermediate transfer belt onto a transfer medium fed from a feeding device. The transfer medium having received the multicolor image is delivered by a delivery belt to a fixing device, where the toner image is fixed on the transfer medium by heating and pressing with a fixing roller and a pressure roller. The transfer medium having the toner image fixed thereon is discharged out of the apparatus.

Such an image forming apparatus has a plurality of detectors, namely jam sensors, for detecting the transfer medium to confirm the reliable feed, delivery, and discharge of the transfer medium which are provided on the paths of feed, delivery, and discharge. Another detector for transfer medium is provided also just behind the fixing roller and the pressure roller (in the vicinity on the downstream side thereof) to detect the winding of the transfer medium onto the rollers.

The detector for the transfer medium has a flag which is energized in one direction by a spring or the like and is swung only on passage of the transfer medium, and a photosensor which is turned on and off by means of the flag.

The above conventional apparatus, however, may have disadvantages described below owing to direct rubbing of the transfer medium with the flag on passage of the transfer medium through the transfer medium detecting means.

When the transfer medium is an OHT, it is easily scratched in stripes on its portions rubbed with the flag because the OHT is very liable to be scratched.

When images are formed on both faces of the transfer medium, the flag slides necessarily on the surface of the image having been formed on the first face at the time of forming an image on the second face, thus scratching the image in stripes or scraping the image on the first face of the transfer medium.

Further, the portion of the flag coming in contact with the transfer medium may be worn out, and the amount of the contact may become reduced.

SUMMARY OF THE INVENTION

It is the object of the present invention to provide an image forming apparatus which will not cause scratching of a transfer medium or an image surface even when images are formed on a transfer medium like OHT or on the both sides of the transfer medium and which will not cause wearing of the contacting portion.

According to the present invention, there is provided an image forming apparatus comprising a transfer medium detecting means having a contact member brought into contact with a sheet of transfer medium separately fed to detect passage of the transfer medium by linear movement, swing movement, or the like movement of the contact member, said contact member having a contact portion brought into contact with the transfer medium which is a roller held rotatably, said roller being adapted to rotate by the passage of the transfer medium.

The roller may be brought into contact with a non-image carrying face or an image carrying face of the transfer medium.

The surface material of the roller has a contact angle of not less than 90° to pure water, and a heat-resistance temperature of not lower than 180° C.

With the above constitution, the detection means for detecting a transfer medium on contacting with the transfer medium has a rotatable roller at the contact portion with the transfer medium, and the roller is rotated by movement of the transfer medium without rubbing with the transfer medium, thus preventing scratch from occurring even with a readily scratchable transfer medium like OHT. Therefore, the image is not scraped even if the transfer medium detection device is brought into contact with the image having been formed on the transfer medium. Further, the contact member brought into contact with the transfer medium is prevented from being worn out.

DESCRIPTION OF THE PREFERRED EMBODIMENTS

Figure 1:
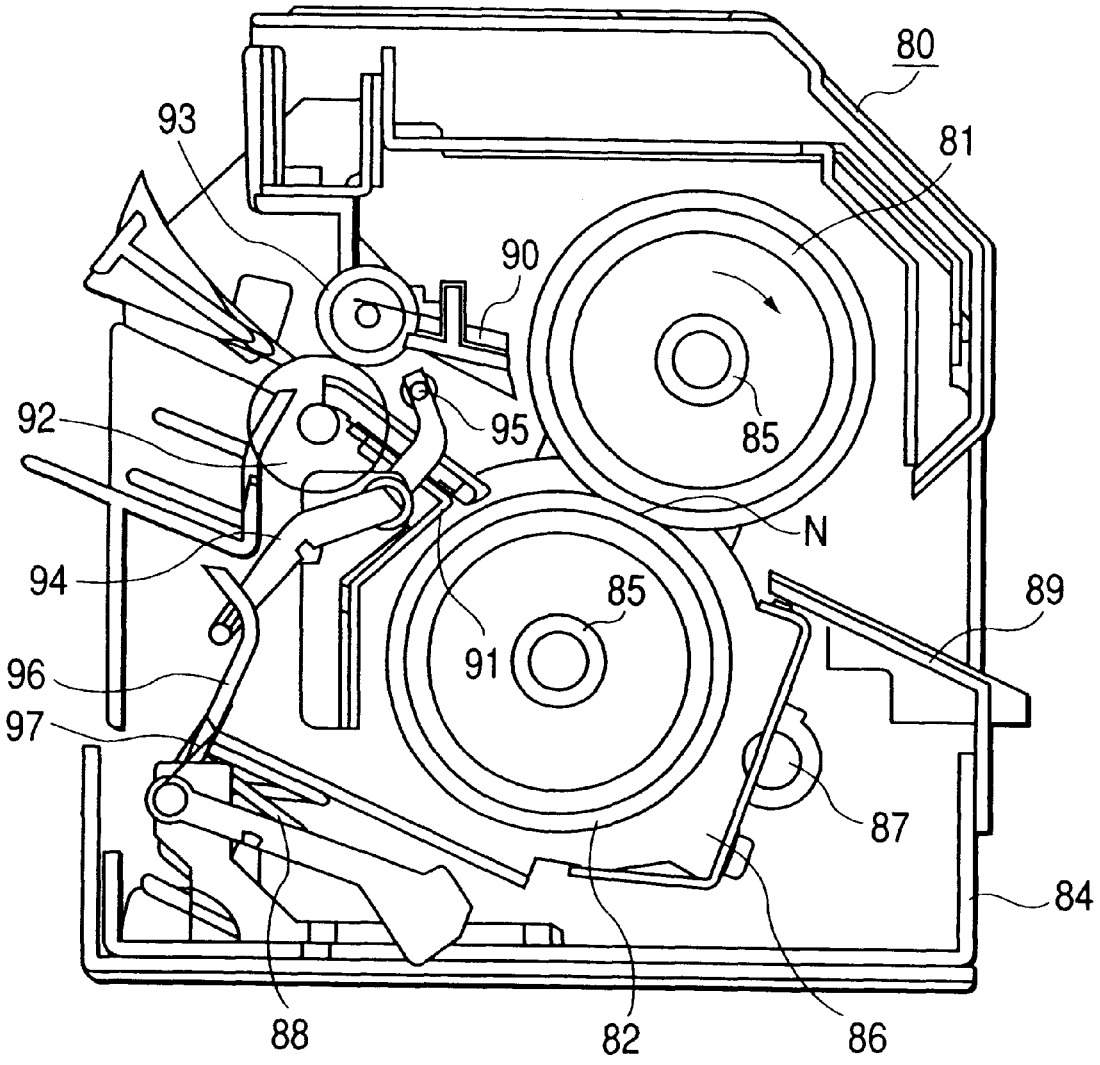
FIG. 1 is a schematic sectional view of a fixing device of a first embodiment according to the present invention.

The constitution of an image forming apparatus of the present invention is described below in detail by reference to the drawings.

EXAMPLE 1

An image forming apparatus of a first embodiment is explained in detail by reference to FIGS. 1 and 2.

Firstly, the constitution of the image forming apparatus is explained by reference to FIG. 2. FIG. 2 is a schematic vertical sectional view illustrating the constitution of the image forming apparatus of the present invention. This embodiment shows a full-color laser beam printer of electrophotography type as an example of the image forming apparatus. The image forming apparatus A shown in FIG. 2 has a drum type electrophotographic photosensitive member 1 (hereinafter referred to as "photosensitive drum") as a first image holding member. The photosensitive drum 1 is driven for rotation in the counterclockwise direction in FIG. 2 by a driving means (not shown in the drawing). Around the photosensitive drum 1, there are provided, in the named order, in the rotational direction, electrifying device 2 for electrically charging the surface of photosensitive drum 1 uniformly, light exposure means 3 for forming an electrostatic latent image on photosensitive drum 1 by projecting a laser beam in accordance with image information, developing device 4 for developing the electrostatic latent image as a toner image with a toner, transferring unit 5 serving as a second image-holding member which undergoes the primary transfer of the toner image from photosensitive drum 1, cleaning device 6 for removing the toner remaining on the surface of photosensitive drum 1 after the primary transfer of images.

In this embodiment, photosensitive drum 1, electrifying device 2, and cleaning device 6 for toner removal are integrated into a process cartridge B which is adapted to be detachably mounted in the main body 14 of the image forming apparatus A.

Additionally in this embodiment, there are provided feeding means 7 for feeding a transfer medium (third image-holding member) S to transfer unit 5, delivery means 12 for delivering the transfer medium S, and fixing device 80 for fixing the toner image on the transfer medium after receiving the secondary transfer.

The constitutional elements are described below successively, beginning with photosensitive drum 1.

Photosensitive drum 1 is constituted, for example, of an aluminum cylinder of about 47 mm diameter having an outer peripheral face coated with an organic photoconductive layer (OPC photosensitive material). Photosensitive drum 1 is supported rotatably at the both ends by supporting members, and is driven for rotation in the direction of the arrow by a driving force transmitted from a driving motor (not shown) to the one end of the drum.

Electrifying device 2 may be of a contact-charging type as shown in Japanese Patent Laid-Open Application No. 63-149669. The electrification member is an electroconductive roller in the shape of roller. The surface of photosensitive drum 1 is electrically charged uniformly by bringing this roller into contact with the surface of photosensitive drum 1 and applying an electrification bias by a power source (not shown).

Light-exposing means 3 has a polygon mirror 3*a*. An image-forming light beam is introduced to this polygon mirror 3*a* in correspondence with an image signal from a laser diode (not shown). Polygon mirror 3*a* is rotated at a high speed by a scanner motor (not shown). The reflected image-forming light beam is exposed through focusing lens 3*b*, reflection mirror 3*c*, and so forth selectively onto the surface of an electrified photosensitive drum 1 to form an electrostatic latent image.

Developing device 4 comprises rotating member 4A capable of fractional rotation around axis 4*d*, and four developing assemblies 4Y, 4M, 4C, and 4B*k* mounted thereon and holding respectively toners of yellow, magenta, cyan, and black. Developing assembly 4B*k* may be omitted arbitrarily. In development of the latent image formed on photosensitive drum 1, the prescribed developing assembly of the color to be applied to the latent image is brought to the position for the development. More specifically, rotating member 4A is fractionally rotated and stopped to bring a prescribed developing assembly to the development position opposing to photosensitive drum 1 with a vary small gap (about 300 $\mu$m) between developing sleeve 4*b* of the developing assembly and photosensitive drum 1, and then the electrostatic latent image on photosensitive drum 1 is developed. The development is conducted as follows. A toner of a color to be developed is supplied by means of a feed mechanism from a toner container of the developing assembly to toner applicator roller 4*a*, and the toner is then applied in a thin layer on the outer periphery of rotating developing sleeve 4*b* by means of rotating applicator roller 4*a* and toner-regulating blade 4*c*, while an electric charge is applied (frictional electrification) to the toner. A development bias is applied between developing sleeve 4*b* and photosensitive drum 1 carrying an electrostatic latent image formed thereon to allow the toner adhere onto the electrostatic latent image to develop it as a toner image. Each of developing sleeves 4*b* of the respective developing assemblies 4Y, 4M, 4C, and 4B*k* is designed to be connected to high voltage power source for the color development provided in the main body of image forming apparatus 14 when the developing assembly is led to and placed at the development position. There, the voltage is applied for development of each of the colors selectively. The developing assemblies 4Y, 4M, 4C, and 4B*k* are designed to be individually detachable from rotating member 4A, and this rotating member 4A is designed to be demountable from main body 14 of the apparatus.

Transfer unit 5 serving as a second image-holding member transfers further a plurality of toner images, which are superimposed successively by the primary transfer from photosensitive drum 1, secondarily onto transfer medium 5 at a time (secondary transfer). Transfer unit 5 has an intermediate transfer belt 5*a* moving in the direction of arrow R5. Intermediate belt 5*a* in this embodiment is a belt having a periphery length of about 440 mm, which is held and extended by three rollers of driving roller 5*b*, secondary transfer counter roller 5*c*, and driven roller 5*d*. In proximity to driven roller 5*d*, pressure roller 5*j* is provided which is designed to retreat so as to take the position for pressing intermediate transfer belt 5*a* against photosensitive drum 1 and the position for intermediate transfer belt 5*a* to part from photosensitive drum 1. Intermediate transfer belt 5*a* is driven in the direction of arrow-R5 by rotation of driving roller 5*b*. Additionally, at a prescribed position outside the intermediate transfer belt 5*a*, cleaning unit 5*e* is provided which is capable of coming to contact with and separating from the surface of intermediate transfer belt 5*a* to remove at a time a toner remaining after the collective secondary transfer onto the transfer medium S described later. This cleaning unit 5*e* brings electrification roller 5*f* into contact with intermediate transfer belt 5*a* to apply to the toner an electric charge of polarity opposite to that of the charge at the image transfer. The toner to which the opposite electric charge is given may be attracted electrostatically to photosensitive drum 1, and then is recovered by cleaning device 6 described later for cleaning the photosensitive drum 1. Incidentally, the method of cleaning the intermediate transfer belt 5*a* is not limited to the above electrostatic cleaning but may be a mechanical method using a blade or a fur brush, or a combination of these methods.

Cleaning device 6 removes the untransferred toner remaining on the surface of photosensitive drum 1 after the primary transfer of the toner images developed by developing device 4 onto intermediate transfer belt 5*a*.

Feeding means 7 feeds transfer medium S to the image forming section. This feeding means 7 comprises feed cassette 7*a* storing plural sheets of transfer medium S and being set in a lower portion of main body 14 of the image forming apparatus. On image formation, pick-up member 7*e* and delivery roller 7*b* are driven in accordance with the image forming operation. Thereby, transfer medium S in feed cassette 7*a* is fed one by one separately and guided by guide plate 7*c* and fed through registration roller 7*d* to intermediate transfer belt 5*a*.

Delivery means 12 delivers transfer medium S after image formation to fixing device 80, and is constituted of plural belts, and other parts.

Fixing device 80 fixes plural toner image transferred secondarily onto transfer medium S, and comprises fixing roller 81 as a fixation rotator driven to rotate, and pressure roller 82 as a pressing rotator which is brought into pressure contact with fixing roller 81 to apply heat and pressure to transfer medium S. Transfer medium S, after passing through secondary transfer roller 5*n* for performing the collective transfer of toner from intermediate transfer belt 5*a*, is heated and pressed by fixing roller 81 and pressure roller 82 during the passage through fixing device 80. Thereby, a toner image of plural colors is fixed on the surface of transfer medium S. The constitution and operation of this fixing device 80 is described later in more detail.

Next, the image forming operation is described with the image forming apparatus of the above constitution.

Figure 2:
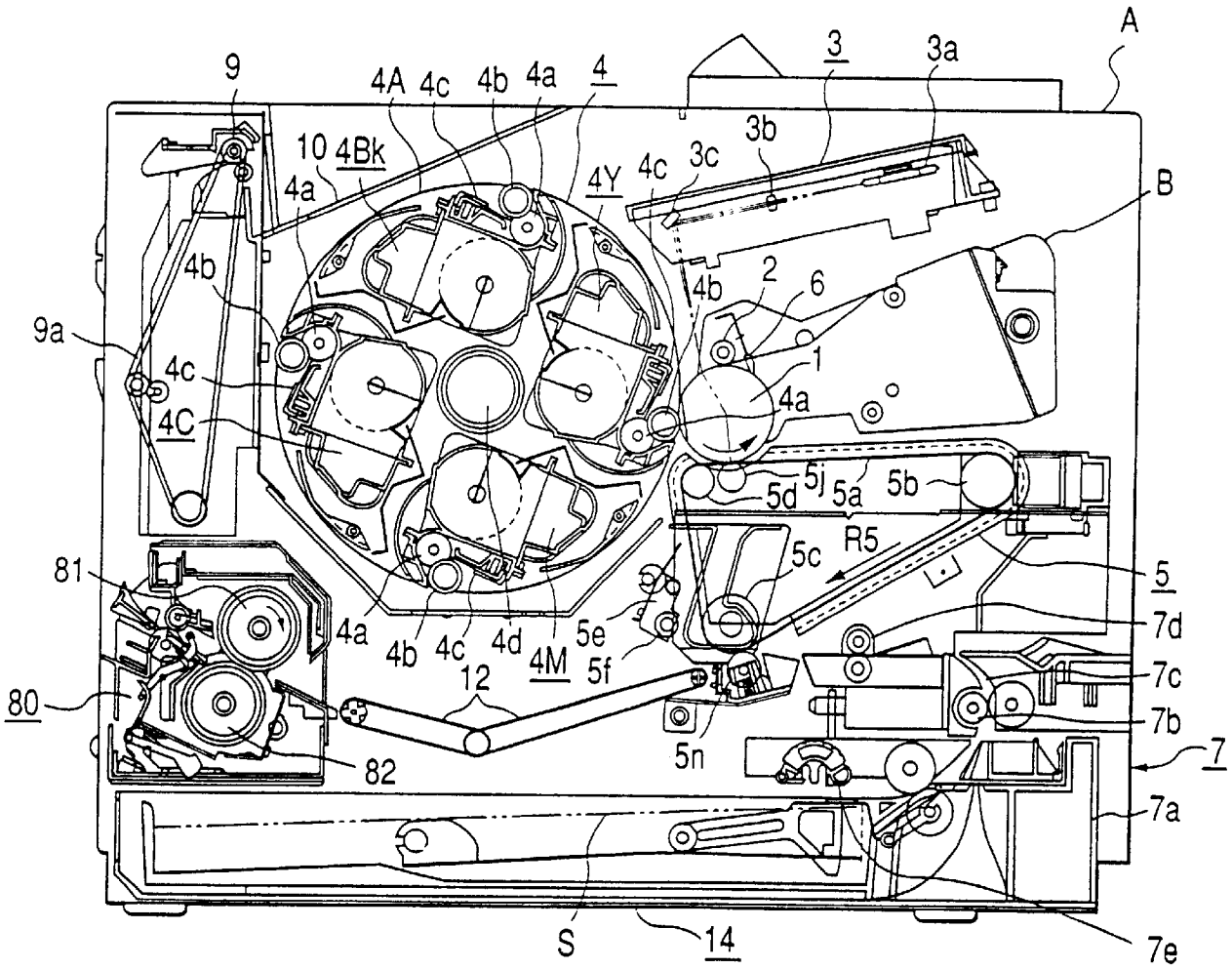
FIG. 2 is a schematic vertical sectional view of an image forming apparatus of the present invention.

Photosensitive drum 1 is rotated in the direction of the arrow (counterclockwise) in FIG. 2 in synchronization with the rotation of intermediate transfer belt 5*a*. Thereby, the surface of photosensitive drum 1 is electrified uniformly by means of electrifying device 2, and is exposed to light of a yellow image by light exposing means 3 to form a yellow electrostatic latent image on photosensitive drum 1. Simultaneously with the formation of the electrostatic latent image, developing device 4 is driven to bring and place developing assembly 4Y for yellow at the development position. Then the electrostatic latent image is developed by application of a voltage of the same polarity as and substantially the same potential as that applied to the photosensitive drum 1 to cause adhesion of a yellow toner onto the electrostatic latent image on photosensitive drum 1. A voltage of polarity opposite to that of the toner is applied to the primary transfer roller (driven roller) 5*d* to perform a primary transfer of the yellow toner image from photosensitive drum 1 onto intermediate transfer belt 5*a*.

After completion of the primary transfer of the yellow toner image as described above, the next developing assembly is moved by rotation so that it is placed at the development position opposed to photosensitive drum 1. The formation of an electrostatic latent image, and development and primary transfer thereof are conducted successively for the respective colors of magenta, and cyan, and if necessary for black, in the same manner as in the case of yellow color. The toner images of the four colors are superimposed on intermediate transfer belt 5*a*. The toner images are collectively transferred secondarily (secondary transfer) onto transfer medium S fed by feeding means 7.

Transfer medium S, after receiving the secondarily transferred image, is delivered to fixing device 80 to fix the toner image thereon, and is discharged by belt 9*a* and discharge roller 9 driven by belt 9*a* to discharge tray 10 outside main body 14 of the image forming apparatus. Thus the image formation is completed.

Constitution of Fixing Device

The constitution and the operation of a fixing device of a first embodiment is described below in detail by reference to FIG. 1. FIG. 1 is a schematic sectional view of the fixing device of the first embodiment.

In FIG. 1, fixing roller 81 as a fixation rotator is constituted of a metal pipe (core metal) and an elastic layer. Similarly, pressure roller 82 as a pressing rotator is constituted of a metal pipe (core metal) and an elastic layer. Fixing roller 81 is supported rotatably at the both ends through bearings (not shown) by fixation frame 84. Pressure roller 82 is supported rotatably at the both ends through bearings (not shown) by pressing frame 86. Pressing frame 86 is supported swingably by supporting pivot 87 held firmly by fixation frame 84, and is energized by press spring 88 as a pressing means so as to force pressure roller 82 against fixing roller 81.

To one end of fixing roller 81, a gear (not shown) is attached to rotate together with fixing roller 81, and fixing roller 81 is driven by a driving means (not shown) to rotate in the direction of the arrow mark (clockwise). Since pressure roller 82 is brought into pressure contact with fixing roller 81, pressure roller 82 is driven to rotate in accordance with the rotation of fixing roller 81.

In the insides of fixing roller 81 and pressure roller 82, a halogen heater 85 is provided respectively to heat fixing roller 81 and pressure roller 82 from the inside.

On the upstream side in the vicinity of fixing roller 81 and pressure roller 82, inlet guide 89 is placed to guide transfer medium S to the nip portion N between fixing roller 81 and pressure roller 82.

On the downstream side in the vicinity of fixing roller 81 and pressure roller 82, there are provided upper discharge guide 90, lower discharge guide 91, fixation-discharge roller 92, roller 93 counter to the discharge roller, and so forth to guide and discharge the transfer medium S undergoing the image fixation by fixing roller 81 and pressure roller 82.

Flag 94 for detecting the passage of transfer medium S is supported swingably on the side of the lower discharge guide on the downstream side of fixing roller 81 and pressure roller 82. At the tip portion of flag 94 sliding on transfer medium S, roller 95 as a rotator is supported rotatably. The surface of this roller may be smooth, or may have depressions or may be rough if necessary.

Lever 96 is supported swingably with swing of flag 94. Lever 96 is energized by spring 97, so that flag 94 and lever 96 swing only on the passage of transfer medium S against the energizing force. The swing of lever 96 is detected by a photosensor (not shown).

Transfer medium S receiving the secondary transfer is guided to inlet guide 89 and is introduced to nip N between fixing roller 81 and pressure roller 82. Transfer medium S having passed through nip N is brought into contact with roller 95 on its non-image face side, and as a result, flag 94 is swung, thereby causing lever 96 to swing. In this state, roller 95 supported rotatably is driven to rotate by the passing movement of transfer medium S.

Roller 95 is usually brought into contact with the non-image face side of transfer medium S. However, in double-side printing in which images are formed on the both faces of the transfer medium S, roller 95 comes to be brought into contact with the image face side thereof. Since transfer medium S immediately after passage through the fixation portion, namely nip N, is at a very high temperature, roller 95 should be heat-resistant, preferably having a heat-resistance temperature of not lower than 180° C. The "heat-resistance temperature" herein means the maximum heating temperature of a material at which the heated material without loading does not cause any change in appearance, like swelling and cracking. Furthermore, the toner image formed on the surface of transfer medium S is in an incompletely molten state, so that the roller 95 coming to contact with the toner image should not be sticking to the molten toner not to cause scrape on the image. As the index for non-stickiness, the contact angle to pure water on the roller surface is not less than 90°. In this embodiment, roller 95 is made of a tetrafluoroethylene-perfluoroalkyl vinyl ether copolymer resin (hereinafter referred to as "PFA"). This PFA has a heat resistance temperature of not lower than 200° C., and shows a contact angle with water of about 110°. PFA is a fluororesin having high non-stickiness and high heat-resistance. However, any other fluororesins such as PTFE and FEP, or other resins may be used provided that they satisfy the requirements of the non-stickiness and the heat resistance.

With the above constitution, the transfer medium detecting means can prevent the transfer medium from being scratched even when it is a transfer medium readily scratchable like OHT. Further, during the double-sided printing, the contact of the transfer medium detecting means with the image-carrying face side does not cause scraping or the like impairment of printed image. Furthermore, the contact member brought into contact with the transfer medium can be prevented from being worn out.

Table 1 shows comparison between the this embodiment and a conventional example concerning the wearing of the contact member, the toner adhesion during the double-side printing and other properties.

As shown in Table 1, this embodiment is excellent in prevention of wearing of the contact member and prevention of the toner adhesion in the double-sided printing, and other properties in comparison with the conventional example.

TABLE 1

| | Wearing of contact member | | | Double-sided printing | |
|---|---|---|---|---|---|
| | 10,000 sheets | 30,000 sheets | 50,000 sheets | Streak on image | Toner adhesion |
| Roller employed (Example 1) | No wear | No wear | No wear | None | None |
| Roller not employed (Conventional) (Lever) | 0.5 mm | 1.0 mm | — | Observed | Observed |

EXAMPLE 2

A fixing device of a second embodiment is described in detail by reference to FIG. 3. The construction of the image forming apparatus is similar to aforementioned embodiment. Therefore, the detailed description thereof is omitted. In the description below, the same symbols are used for the members having the same functions as in the above embodiment without explanation thereof.

Constitution of Fixing Device

The constitution and the operation of fixing device 80 of a second embodiment is described below in detail by reference to FIG. 3. FIG. 3 is a schematic sectional view of the fixing device of the second embodiment.

Firstly, the constitution of fixing device 80 of this embodiment is explained.

In the aforementioned first embodiment, roller 95 and flag 94 of the transfer medium detecting means are usually brought into contact with the non-image side of the transfer medium. On the other hand, in this embodiment, roller 95 and flag 94 of the transfer medium detecting means are usually brought into contact with the image side as shown in FIG. 3.

Figure 3:
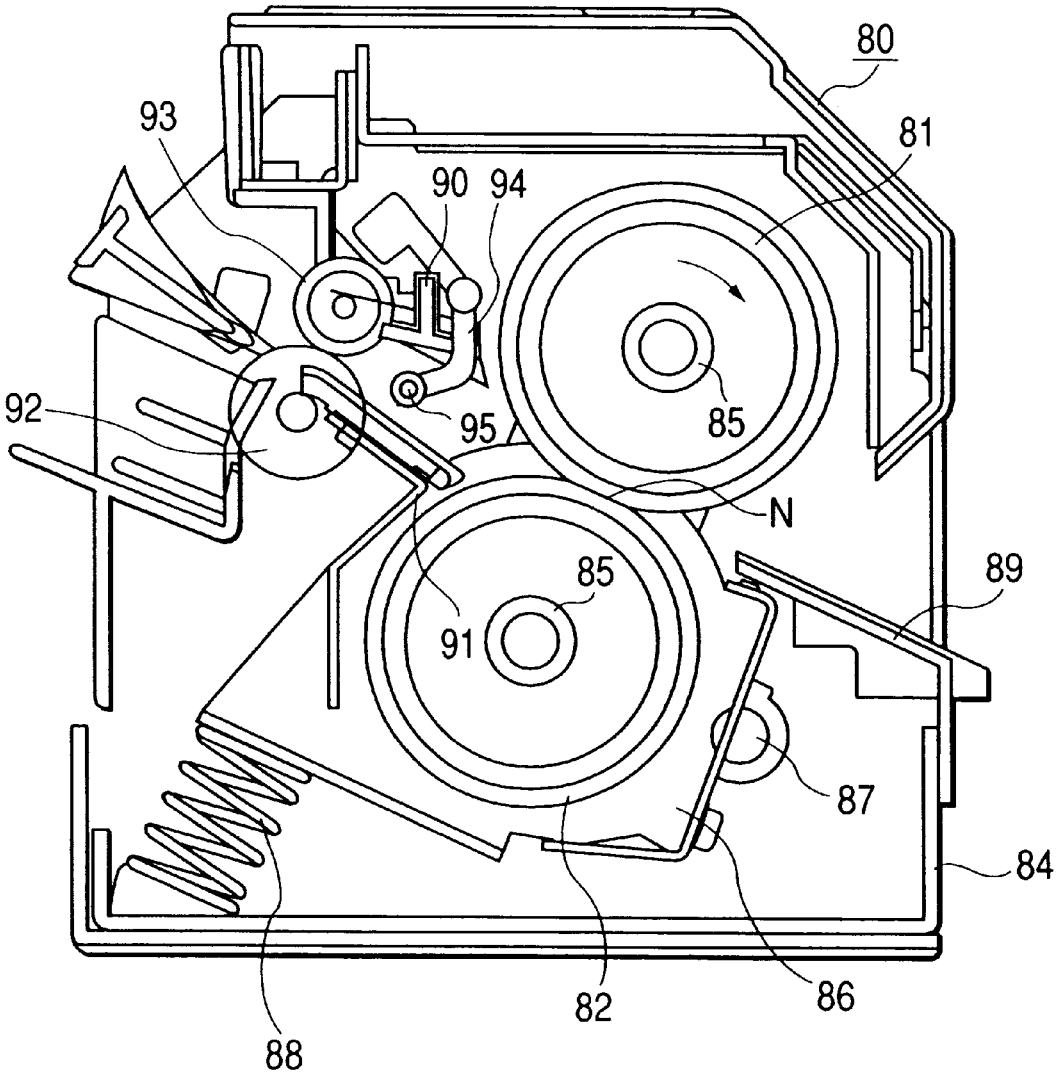
FIG. 3 is a schematic sectional view of a fixing device of a second embodiment according to the present invention.

In FIG. 3, flag 94 is supported swingably by upper discharge guide 90. At the tip portion of flag 94 sliding on the transfer medium, roller 95 as a cylindrical rotator is supported rotatably. Flag 94 is energized in one direction by the self weight or a spring (not shown), and swings against the energizing force only on passage of the transfer medium. The swinging of flag 94 is detected by a photosensor (not shown) provided on the side opposite to roller 95 of flag 94.

Transfer medium S after the secondary transfer is guided to inlet guide 89, and is introduced to nip N between fixing roller 81 and pressure roller 82 which are driven to rotate. Transfer medium S having passed through nip N is brought into contact with roller 95 on its image-carrying face side, whereby flag 94 is swung. Roller 95 supported rotatably is driven to rotate by the passing movement of transfer medium S.

Transfer medium S immediately after passage through the fixation portion, namely nip N, is at a very high temperature, and the toner image formed on the surface of transfer medium S is not completely solidified. Therefore, roller 95 to be brought into contact with the toner image should be heat-resistant, and should not be sticky to the molten toner so as not to cause scraping of the image. In this embodiment also, roller 95 is made of PFA similarly to the first embodiment.

With the above constitution, even the transfer medium detecting means of a type which detects the transfer medium by being brought into contact with the image face side of the transfer medium can prevent the image scraping or the like impairment from occurring. Furthermore, the contact member to be brought into contact with the transfer medium can be prevented from being worn out.

Table 2 shows the results of the test for the image scratch, and the toner adhesion in the second embodiment in which the roller 95 is brought into contact with the image face side. Neither the streaking on the image nor the toner adhesion was observed, yielding satisfactory results.

TABLE 2

| | Streak on image | Toner adhesion |
|---|---|---|
| Roller employed (Example 2) | Not observed | Not observed |

Other Examples

The above embodiments use laser beam printers of an electrophotography type as an example of the image forming apparatus. The present invention is not limited thereto, but is applicable to image forming apparatuses employing other types of recording system such as an ink-jet printing system.

In the above embodiments, printers are employed as an example of the image forming apparatus. The present invention is not limited thereto, but is applicable also to other types of image forming apparatuses such as a copying machines and facsimiles.

In the above embodiments, multicolor image forming apparatuses are shown which are capable of forming color images. The present invention is not limited thereto, but is applicable also to unicolor image forming apparatus for forming monochromatic images.

In the above embodiments, the application to fixing devices of image forming apparatuses is shown. The present invention is not limited thereto, but is naturally applicable also to the transfer medium feeding section, the transfer medium delivery section, and so forth.

What is claimed is:

1. An image forming apparatus comprising a transfer medium detecting means having a contact member brought into contact with a sheet of transfer medium separately fed to detect passage of the transfer medium by movement of the contact member, said contact member having a contact portion brought into contact with the transfer medium which is a roller held rotatably, said roller being adapted to rotate by the passage of the transfer medium, wherein the roller is disposed between a section of fixing a toner image formed on the transfer medium and a section of discharging the transfer medium, and the transfer medium passing against an energizing force given the roller.

2. The image forming apparatus according to claim 1, wherein the fixing section is a nip portion between a fixing roller and a pressure roller.

3. The image forming apparatus according to claim 1, wherein the roller is supported by a flag supported swingably.

4. The image forming apparatus according to claim 3, wherein the flag is energized.

5. The image forming apparatus according to claim 1, wherein the roller is brought into contact with a non-image carrying face or an image carrying face of the transfer medium.

6. The image forming apparatus according to claim 1 or 5, wherein said roller is made of a material having a contact angle of not less than 90° to pure water, and a heat-resistance temperature of not lower than 180° C.

7. The image forming apparatus according to claim 6, wherein the material of the roller is nonsticky to a melted toner.

8. The image forming apparatus according to claim 6, wherein the material of the roller is a fluororesin.

9. The image forming apparatus according to claim 6, wherein the material of the roller is a resin of a tetrafluoroethylene-perfluoroalkyl vinyl ether copolymer.

10. The image forming apparatus according to claim 1, having a yellow toner developing device, a magenta toner developing device and a cyan toner developing device.

* * * * *

UNITED STATES PATENT AND TRADEMARK OFFICE

CERTIFICATE OF CORRECTION

PATENT NO. : 6,215,965 B1
DATED : April 10, 2001
INVENTOR(S) : Hitoshi Sato

It is certified that error appears in the above-identified patent and that said Letters Patent is hereby corrected as shown below:

Title page,
Item [56], References Cited, U.S. PATENT DOCUMENTS, "Hyskutake et al." should read -- Hyakutake et al. --.

Column 1,
Line 30, "d rum" should read -- drum --.

Column 4,
Line 34, "medium 5" should read -- medium S --.

Column 7,
Line 26, "the" should be deleted.

Signed and Sealed this

Twenty-fourth Day of June, 2003

JAMES E. ROGAN
*Director of the United States Patent and Trademark Office*